United States Patent [19]

McCrane

[11] Patent Number: 4,958,384

[45] Date of Patent: Sep. 25, 1990

[54] SAFETY GLOVE

[76] Inventor: David P. McCrane, 1740 Main St., St. Helena, Calif. 94574

[21] Appl. No.: 274,987

[22] Filed: Nov. 22, 1988

[51] Int. Cl.[5] ..... A41D 19/00

[52] U.S. Cl. ..... 2/162; 2/161 A; 2/20

[58] Field of Search ..... 2/159, 160, 161 A, 161 R, 2/162, 170, 16, 18, 19, 20, 158; 272/67, 68, 93, 119; 273/54 B, 189 R, 189 A, 166

[56] References Cited

U.S. PATENT DOCUMENTS

| | | | |
|---|---|---|---|
| 425,887 | 4/1890 | Kohler | 2/19 |
| 2,154,197 | 4/1939 | Callaway | 2/161 R |
| 2,369,115 | 2/1945 | Bloom | 2/16 |
| 2,695,999 | 12/1954 | Arnold | 2/20 |
| 2,794,638 | 6/1957 | Risher et al. | 2/162 X |
| 2,952,921 | 9/1960 | Finn | 2/20 |
| 3,031,680 | 5/1962 | Compiano | 2/159 |
| 3,164,841 | 1/1965 | Burtoff | 2/161 |
| 3,344,436 | 10/1967 | Stubbs | 2/159 |
| 3,581,312 | 6/1971 | Nickels | 2/159 |
| 3,606,614 | 9/1971 | Dimitroff | 2/159 |
| 3,643,386 | 2/1972 | Grzyll | 2/161 |
| 3,890,649 | 6/1975 | Diggins | 2/16 |
| 4,057,255 | 11/1977 | Bishop | 2/161 A X |
| 4,071,913 | 2/1978 | Rector | 2/161 |
| 4,309,991 | 1/1982 | DeMarco | 273/54 B X |
| 4,400,831 | 8/1983 | Rietz | 2/161 A |
| 4,438,532 | 3/1984 | Campanella et al. | 2/161 A X |
| 4,502,688 | 3/1985 | Papp | 2/161 A X |
| 4,525,877 | 7/1985 | Chong | 2/163 X |
| 4,829,604 | 5/1989 | Allen et al. | 2/162 X |
| 4,843,651 | 7/1989 | Gramza et al. | 2/163 X |
| 4,905,321 | 3/1990 | Walunga | 2/160 X |

*Primary Examiner*—Werner H. Schroeder
*Assistant Examiner*—Sara M. Current
*Attorney, Agent, or Firm*—Flehr, Hohbach, Test, Albritton & Herbert

[57] ABSTRACT

A safety glove for use by people engaged in active sports or in industrial job activities to protect against hyperextension of ligaments and tendons in the wrist. The glove includes a body having palm and back portions joined to fit about the hand. An inelastic wrist strap is attached at its proximal end to the body and extends along a length sufficient to wrap about the person's wrist in the range of one and one-half to substantially three turns, depending upon the requirements of the particular sports or job activity. Finger receptacles are formed for receiving the thumb and fingers of the person's hand. In one embodiment the strap tapers from an enlarged proximal end to a smaller width at the distal end. In another embodiment the strap is of substantially uniform width along its length.

10 Claims, 2 Drawing Sheets

SAFETY GLOVE

This invention relates to safety gloves for use by people engaged in active sports or in industrial job activities.

Various types of safety and protective gloves have been provided for people engaged in sports and job activities. In general these prior art gloves are designed with padding, abrasive-resistant surfaces, shields and the like which are adapted for the particular activity. For example, U.S. Pat. No. 4,071,913 to Rector provides a protective glove for use in skateboarding having an elastic wristband as well as a palm pad to absorb impact forces when the person's hand strikes the ground in a fall. U.S. Pat. No. 3,031,680 to Compiano provides a bowling glove with pads suited for that particular sport. U.S. Pat. No. 3,643,386 to Grzyll provides a glove with an abrasive material for use in a cleaning job. U.S. Pat. No. 3,164,841 to Burtoff provides a safety glove having a series of rings of a rigid material placed over portions of the fingers to protect against heavy impact from a machine or hammer. These previously-known glove designs, however, do not provide sufficient protection to prevent hyperextension of the ligaments and tendons of the wrist in the type of activity where sprains to the wrist can be encountered.

Accordingly, it is a general object of the present invention to provide a new and improved safety glove for use by people engaged in active sports or in industrial job activities where there is a danger of wrist sprains.

Another object is to provide a safety glove of the type described in which the glove body has an inelastic wrist strap adapted to wrap around the user's wrist to secure the glove while tightly binding the wrist against flexure to protect against hyperextension of the ligaments and tendons in the wrist.

Another object is to provide a safety glove of the type described which protects the user's wrists against hyperextension in such active sports as skateboarding, weightlifting, bicycling, football and snowboarding.

Another object is to provide a safety glove of the type described to protect a user's wrist against hyperextension in industrial job activities such as by freight handlers and by longshoremen.

The invention in summary comprises a glove having a body with a palm portion joined to a back portion for fitting about the person's hand. Receptacles are formed in the body for receiving the thumb and fingers of the hand. An inelastic wrist strap is attached at its proximal end to the glove body and extends along its length sufficient to wrap about the person's wrist in the range of one and one-half to substantially three turns, depending upon the requirements of the particular sport or job activity. In one embodiment the strap tapers from an enlarged proximal end toward a smaller distal end. In another embodiment the strap is of substantially uniform width along its length.

The foregoing and additional objects and features of the invention will appear from the following specification in which the several embodiments have been set forth in detail in conjunction with the accompanying drawings.

Figure 1:
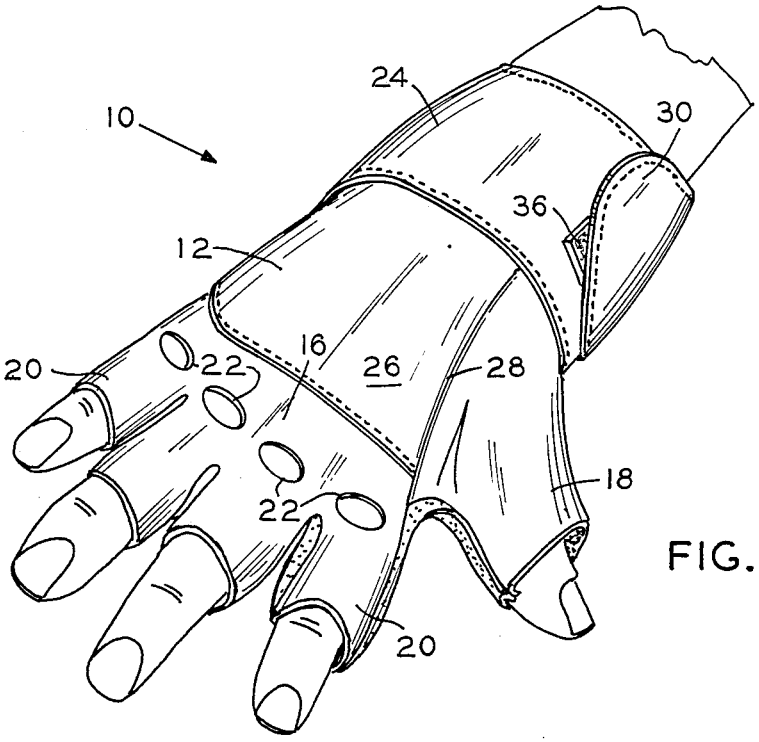
FIG. 1 is a perspective view of a safety glove according to one embodiment.

In the drawings FIGS. 1–4 illustrate generally at 10 the safety glove according to one embodiment which is adapted for use in the sport of skateboarding. While glove 10 is illustrated as adapted for use in skateboarding, it is understood that the invention has a range of application for use in active sports and industrial job activities where it is desired to protect the wrist against hyperextension or sprains.

Glove 10 is comprised of a glove body 12 having a palm portion 14 joined with a back portion 16 shaped to generally conform with the user's hand. Preferably palm portion 14 is formed of a tough and durable material for withstanding abrasion, for example split leather, top grain leather or artificial leather. Back portion 16 is formed of a suitable compliant material such as top grain leather, artificial leather or cloth.

The ends of the palm and back portion are suitably shaped so when they are joined together they form receptacles or stalls 18, 20 for receiving the thumb and fingers of the person's hand. In the illustrated embodiment half-finger receptacles 20 are shown for use where tactile feedback is desired by the user, such as in the skateboarding sport. The safety glove with these half-finger receptacles is also suitable where the person desires to retain finger dexterity, for example in the sport of football. The receptacles can also be full-fingered for use in applications where it is desired to protect against cool weather, for example bicycling or snowboarding, as well as applications where it is desired to protect the fingers against abrasion, such as for use by longshoremen and freight handlers. The top portions of the finger receptacles can be formed with knuckle holes 22 as desired by the user.

Figure 3:
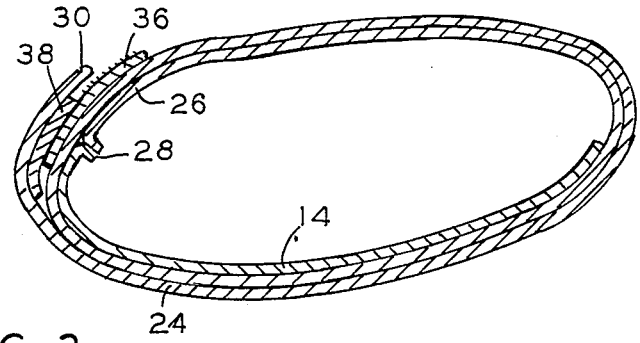
FIG. 3 is a cross-sectional view of the glove of FIG. 1 taken along the wrist portion.
Figure 4:
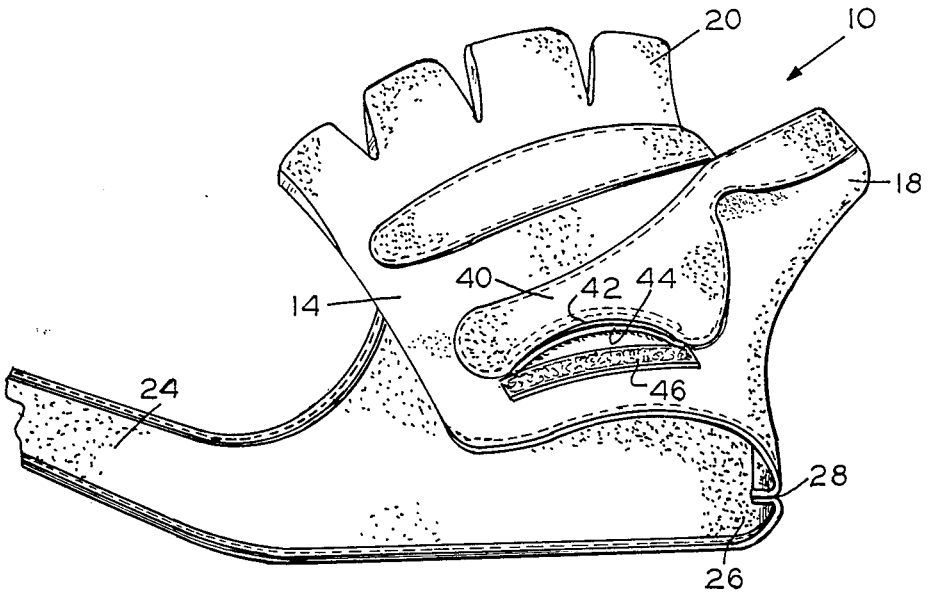
FIG. 4 is a bottom plan view of the glove of FIG. 1.

An inelastic wrist strap 24 is provided for releasably holding the glove body on the hand while firmly holding the wrist against flexure to protect against hyperextension of the ligaments and tendons in the wrist joint. The proximal end 26 of the wrist strap is attached by suitable means such as sewing to a seam 28 of the glove body. The strap 24 extends from distal end 30 to its proximal end along a predetermined length sufficient to wrap about the person's wrist in the range of one and one-half to substantially three turns, depending upon the requirements of the particular sports or industrial activity. In the illustrated embodiment where glove 10 is used in skateboarding, a length of strap sufficient to form from two to two and one-half turns is suitable, as shown in FIG. 3. It is an important feature of the invention that the strap length be sufficient to form the number of turns as described so that when the wrap is secured in place the overlapping turns of the strap grip the wrist firmly enough to protect against hyperextension.

The proximal end 26 of strap 24 is attached along the seam 28 to a side of the back portion 16 as well as a side of the portion of the base of the thumb receptacle 18. The width of the strap proximal end is enlarged in comparison with the width of the portion extending to the distal end, and in the illustrated embodiment the enlarged portion of the proximal end has a width of substantially four and one-half inches with the remaining portion of the strap tapering down along its length to a width in the range of substantially one inch to three inches. In the illustrated embodiment the strap tapers to a width of substantially two inches at the distal end 30.

Figure 2:
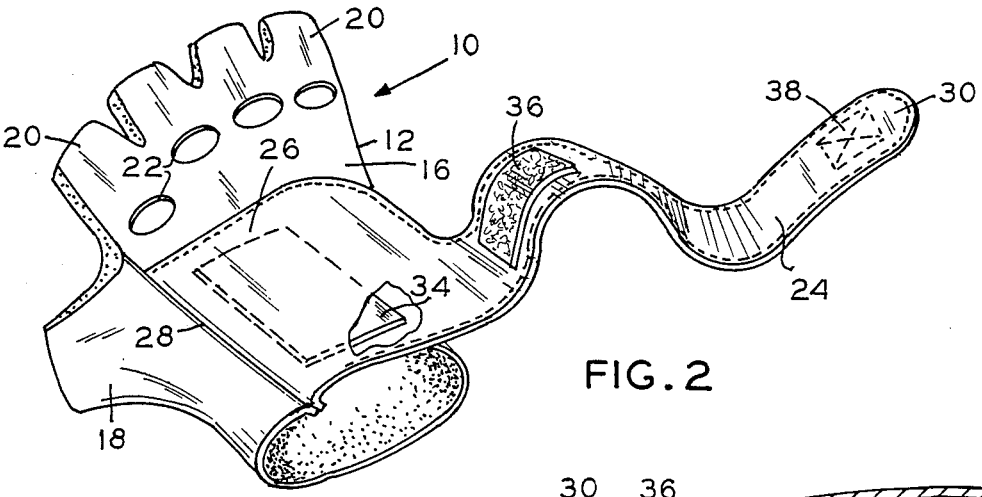
FIG. 2 is a top plan view of the glove of FIG. 1 showing the strap unwrapped.

As shown in FIG. 2 a reinforcing flexible stiffener 34 is secured as by sewing to the inside portion of strap distal end 26. Preferably the stiffener 34 is comprised of a piece of leather in a rectangular shape. As desired suitable indicia such as a company logo or other design can be silk screened or printed onto the top surface of the stiffener and the overlying portion of the strap die cut and removed so that the logo or design on the stiffener shows through.

Fastener means is provided for releasably securing the strap about the user's wrist. Preferably the fastener comprises Velcro, which is a trademark for pads of small complementary hooks and loops which fasten together under hand pressure and which can be quickly separated. A pad 36 of either the Velcro hooks or loops is secured as by sewing to the outer surface of the strap along its midspan and another pad 38 of matching loops or hooks is secured as by sewing to the inner surface of the strap distal end. The separation distance between the two pads is approximately the circumference of one turn of the strap so that the two pads overlie each other when in place.

A pocket 40 is formed on palm portion 14 and is comprised of a layer of leather secured along three of its sides by means such as sewing to the palm. The side 42 of pocket 40 adjacent the wrist is open for insertion of a suitable pad, not shown, which provides additional cushioning, as desired by the user. The open side of the pocket is releasably closed by fastener means which comprises Velcro pads, one pad 44 of which is secured to the inner edge of the pocket layer with the other complementary pad 46 secured to the opposing surface of palm portion 14.

Figure 5:
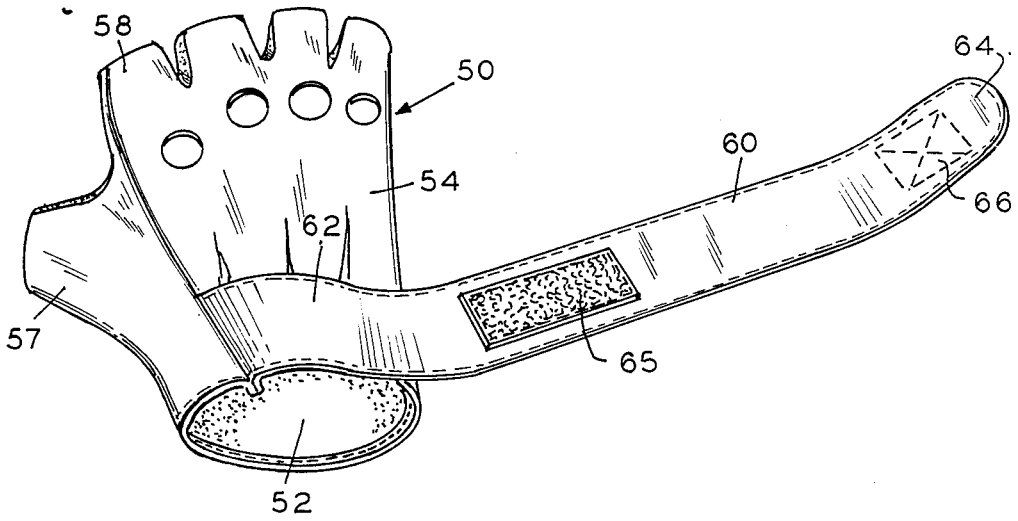
FIG. 5 is a top plan view of a safety glove according to another embodiment of the invention.

FIG. 5 illustrates another embodiment of the invention providing a protective glove 50. Glove 50 is comprised of a palm portion 52, back portion 54 and finger and thumb receptacles or stalls 57, 58 sewn together to fit about a person's hand in a manner similar to that described for the embodiment of FIGS. 1–4. In this embodiment an inelastic wrist strap 60 is secured at its proximal end 62 to the glove body and the strap extends to its distal end 64 with a uniform, substantially untapered, width in the range of substantially one inch to three inches. The strap has a predetermined length from its proximal to distal ends sufficient to wrap about the person's wrist in the range of one and one-half to substantially three turns, depending upon the particular sports or job activity. Fastener means comprising matching Velcro pads 65, 66 is provided on the wrist for releasably securing the strap about the wrist in the manner explained above.

In this embodiment the receptacles can either be full-fingered or half-fingered, as desired by the particular application. Also, a pocket and insertable cushion pad, not shown, can be provided on the palm portion as in the first embodiment.

In use, safety glove 10 of the first embodiment is pulled onto the person's hand with the fingers snugly inserted into the receptacles. The free end of strap 24 is grasped by the user's other hand and wrapped tightly around the wrist. The Velcro pads 36 and 38 are pressed together to secure the strap in place. The multiple, overlaying turns in combination with the inelasticity of the strap material creates a very tight hold about the wrist preventing its flexure. This results in protection against hyperextension of the ligaments and tendons in the wrist joint. Safety glove 10 thereby provides a higher degree of protection against sprains and other wrist injuries, as well as abrasions to the hand, which would otherwise be encountered.

While the foregoing embodiments are at present considered to be preferred it is understood that numerous variations and modifications may be made by those skilled in the art and it is intended to cover in the appended claims all such variations and modifications as fall within the true spirit and scope of the invention.

What is claimed is:

1. A protective safety glove for use by people engaged in active sports or an industrial job activity to protect against hyperextension of the ligaments and tendons in the wrist, said glove comprising the combination of a glove body having a palm portion joined with a back portion to fit about the person's hand, means forming receptacles for the thumb and fingers of the hand, a substantially inextensible wrist strap for releasably holding the glove body on the person's hand and wrist, said strap having a major axis extending from a first end portion to a second end portion, attachment means for fixedly attaching said first end portion to said glove body along a seam which extends in a direction substantially transverse to said major axis for optimal resistance of tension forces along the major axis when the strap is wrapped around the wrist, said first end portion of the strap overlying substantially the back of said hand with a first width which extends from a region adjacent the wrist of the hand to a region adjacent the knuckles of the hand, with the remaining portion of the strap having a second width less than said first width, the strap having a length along its major axis sufficient to form a wrap about the wrist in the range of substantially one and one-half to three turns as required by the particular sport or job activity.

2. A glove as in claim 1 in which the first width of said first end portion is in the range of substantially four inches to five inches, and the second width of the second end portion is in the range of substantially one inch to three inches.

3. A glove as in claim 1 in which the first width of said first end portion is substantially uniform across the region of said knuckles.

4. A glove as in claim 1 for use in the sport of skateboarding in which the length of the strap is sufficient to form a wrap about the wrist which is in the range of two to two and one-half turns.

5. A glove as in claim 1 in which the attachment means attaches a portion of the first end of the strap to a portion of the side of the back portion.

6. A glove as in claim 1 which includes fastener means for releasably securing said strap in its wrapped configuration about the wrist.

7. A glove as in claim 1 which includes a pocket formed on the palm portion of the body, said pocket having an opening on one side thereof for insertion and removal of a cushioning pad into the pocket, and means for releasably closing said opening to capture said pad within the pocket.

8. A glove as in claim 1 for use in sport and job activities which require protection against abrasion or protection against cool weather in which said receptacle means comprises a plurality of full finger stalls mounted on the body for fitting about the person's fingers.

9. A glove as in claim 1 for use in sports and job activity where tactile feedback is desired in which said receptacle means comprises finger stalls mounted at their proximal ends to the body and with their distal ends having openings through which the person's fingers project.

10. A glove as in claim 1 in which a portion of the strap adjacent the first end wraps around the end margin of the palm portion as well as at the end margin of the back portion.

* * * * *